US005671641A

United States Patent [19]

Stephenson, Jr.

[11] Patent Number: 5,671,641

[45] Date of Patent: Sep. 30, 1997

[54] DEVICES AND METHODS FOR GUIDING NAILS

[76] Inventor: Roger Emmett Stephenson, Jr., P.O. Box 36, Forest Falls, Calif. 92339-0036

[21] Appl. No.: 578,737

[22] Filed: Dec. 26, 1995

[51] Int. Cl.[6] ..... B25L 3/00

[52] U.S. Cl. ..... 81/44

[58] Field of Search ..... 81/44; 222/135; 294/99.1, 99.2; 173/90

[56] References Cited

U.S. PATENT DOCUMENTS

| | | | |
|---|---|---|---|
| 1,426,249 | 8/1922 | Bochonok . | |
| 2,563,677 | 8/1951 | Frazier | 81/44 |
| 3,316,949 | 5/1967 | Canfield | 145/46 |
| 3,522,827 | 8/1970 | Muller | 145/46 |
| 3,900,617 | 8/1975 | Grenoble | 427/387 |
| 3,922,464 | 11/1975 | Silver et al. | 428/355 |
| 3,946,779 | 3/1976 | Sudol | 145/46 |
| 4,139,036 | 2/1979 | Regan et al. | 145/46 |
| 4,422,489 | 12/1983 | Ross | 145/46 |
| 4,493,353 | 1/1985 | Thomas | 145/46 |
| 4,631,985 | 12/1986 | Roberts | 81/44 |
| 4,691,598 | 9/1987 | Lin | 81/44 |
| 4,843,923 | 7/1989 | Voss | 81/44 |
| 4,926,718 | 5/1990 | Cook | 81/44 |
| 4,966,056 | 10/1990 | Miller | 81/44 |
| 5,182,972 | 2/1993 | Skaleski | 81/44 |
| 5,370,020 | 12/1994 | Fifield et al. | 81/44 |

*Primary Examiner*—James G. Smith
*Attorney, Agent, or Firm*—Law Office of Albert J. Dalhuisen

[57] ABSTRACT

The present invention provides devices and methods for holding and guiding nails. The nail guide devices comprise a flexible polymer foam body having one or more slits for inserting a nail. The foam body may additionally comprise one or more adhesive layers for temporarily bonding the device to a finger or to the surface of a workpiece. Methods are provided to utilize the nail guides of the current invention for seating and driving a nail into a workpiece.

16 Claims, 3 Drawing Sheets

DEVICES AND METHODS FOR GUIDING NAILS

FIELD OF THE INVENTION

The present invention relates to devices and methods for holding and guiding nails. More particularly, the invention relates to devices and methods for holding and guiding nails using flexible polymer foam bodies having one or more slits to guide and position nails. Still more particularly, the invention relates to devices and methods for guiding nails using flexible polymer foam bodies having one or more slits to guide and position the nails, wherein the polymer foam bodies are provided with an adhesive for the temporary bonding of the foam body to a workpiece or to the user's finger.

BACKGROUND OF THE INVENTION

Nails are commonly used fasteners for attaching, for example, one piece of wood to another. A variety of other materials can also be fastened with nails such as some kinds of sheet metals, plastics, rubber or concrete. Some of these materials may require specialty nails, such as, hardened nails.

Impact tools, such as, hammers and automatic nailers are used to drive the nail into a workpiece. When a hammer is used, the user holds the nail between the thumb and a finger of one hand while positioning the nail. The nail is then driven by the hammer held in the other hand until the nail is firmly seated, after which the user can remove the fingers from the nail and fully drive the nail into the workpiece. The thumb and finger are in effect a means to guide the nail. This method generally works satisfactorily when the nail is relatively long, such as, for example, a 1 ½ inch or longer nail. However, when the nail is relatively short, such as, for example, a 1 inch or shorter nail, it is difficult to fasten the nail with a hammer unless the user is an experienced craftsman, such as a carpenter.

Persons having impaired finger movement such as those who have arthritic finger joints may find it difficult to use the thumb and finger for guiding a nail even when the nail is relatively long. Young children generally have difficulty in using a hammer and nails because of their insufficient manual dexterity and eye-hand coordination.

The difficulties of holding and guiding a nail while using a hammer are aggravated when the surface of the workpiece is not flat or when the nail is to be driven into an area which allows little room for holding a nail onto a workpiece such as inside a corner, or a channel or cup shaped surface section.

Additional practical difficulties are experienced when the workpiece needs to be held in a certain position while the nail is driven into it because the user requires one hand to hold or guide the nail and the other hand for using the hammer. Holding the workpiece in place then requires a second person to position and hold the workpiece or a temporary holding or clamping device for the workpiece.

The practical difficulties associated with holding or guiding nails while using a hammer for driving the nails into a workpiece are well known to those skilled in the art. Various devices and methods have been devised by others attempting to overcome these difficulties. For example, U.S. Pat. No. 5,370,020 (Fifield et al., 1994) discloses a nail holder which includes a pliable molded sculpted hand. A spring is integrally molded within the hand's thumb and forefinger for resiliently holding and guiding a nail. U.S. Pat. No. 4,926,718 (Cook, 1990) discloses a nail holding tool comprising an impact resistant sheath adapted to fit snugly over a user's thumb, wherein the sheath has a nail holding fixture which may comprise a groove in the wall of the sheath and a magnet for attracting and holding a nail in the groove.

U.S. Pat. No. 4,843,923 (Voss, 1989) discloses a fastener-handling tool to assist in the starting of pointed fasteners such as nails, brads, tacks, screws and the like. The tool comprises a one-piece molded elastomer element including attached thereto a slender finger having a reduced cross-section and a hole at its free end for receiving the fastener. A slot in the finger leads cross-wise to the hole. A pin cushion is included for carrying a supply of fasteners. U.S. Pat. No. 4,493,353 (Thomas, 1985) discloses a nail guide and set having a base member which is formed of a resilient material. A metal guide and a rigid cap having a nail set are mounted on the base member for transmitting the impact from a hammer on a nail. A nail starting section integral with the base member extends laterally outward. This section includes nail starting holes with slots to initially grip the nails, including some openings for receiving nails which are at an angle to the workpiece. U.S. Pat. No. 3,946,779 (Sudol, 1976) discloses a nail guide comprising a block of resilient material having a radial slot for gripping a nail and holding it in position during the initial driving of the nail into an object.

Known nail guide and nail holding devices, as exemplified by the above referenced patents, do not provide an optimal design combining ease of use and versatility in order to effectively use these types of devices on uneven and non-flat services. For example, the '020 patent teaches a device which is believed to have a design which is not optimal for positioning a nail on a non-flat surface because of the rather large size of the device. The '718 patent teaches a device which is believed to have a design which is not optimal for guiding small nails because any nail which is shorter than the thickness of the user's thumb cannot be driven with a hammer. Also, the user's thumb is in close proximity to the nail which is guided in the '718 device, thereby risking striking the thumb with the hammer particularly if the user is inexperienced.

The '923 patent teaches a device with an elastomeric finger for holding and guiding a nail wherein the finger is flexible, thus enabling the user to position a nail in a position, such as, for example in an inside corner. However, it is believed that the '923 pin cushion part results in a design which is not optimal for positioning that device in a very confined area such as inside a channel shaped surface section. The '353 patent teaches a device formed of a resilient material. This device is believed to have a design which is not optimal for use on a non-flat surface and difficult to position in a very confined area due its use of a metal guide and rigid cap. The device illustrated in the '779 patent is believed to have a design which is not optimal to overcome the enumerated practical difficulties because it places the user's fingers in relatively close proximity to the nail, thus risking hitting the fingers with the hammer and making it difficult to position the nail in a very confined area.

None of the devices and methods disclosed in the above referenced patents teach that these devices are suitable for driving a nail into a workpiece which needs to be held in a certain position, without the use of a clamp or holding device for the workpiece or the assistance of a second person to hold the workpiece in place.

None of the devices and methods disclosed in the above referenced patents appear to be suitable for handicapped persons having the use of only one hand since these devices appear to require two hands, i.e. one hand for holding the nail guide and the other hand for holding the hammer.

A shortcoming of the devices illustrated in the '020, '923, '353 and '779 patents is the difficulty of accurately placing the nail on a marked position on the workpiece because the above nail guide and holding devices cover and obscure the marked position when the nail guide is positioned for driving it with a hammer.

Accordingly, the need exists for an improved nail guide device and method suitable for relatively short nails and suitable for persons with impaired finger use and particularly for facilitating the positioning of a nail in a very confined area. Additionally, the need exists for an improved nail guide device which enables the user to guide and drive a nail with one hand while holding a workpiece with the other hand. Also, the need exists for an improved nail guide device and method which enables the user to more accurately position the nail on the marked position on a workpiece. There is also an existing need for nail guide devices and methods which can be used by handicapped persons having the use of only one hand.

SUMMARY OF THE INVENTION

The present invention provides novel devices and methods for holding and guiding nails.

In one embodiment the current invention provides a nail guide including a polymer foam body having one or more slits wherein each slit is adapted for insertion of a nail.

In another embodiment the current invention provides a nail guide including a polymer foam body having a slit adapted for inserting a nail, and having a straight line mark on the surface of the foam body such that the mark intersects the slit at the nail holding position.

In yet another embodiment the current invention provides a nail guide including a polymer foam body having a slit for inserting a nail, and having one or more adhesive layers applied to the surface of the foam body.

In another embodiment of the present invention a method is provided for guiding a nail wherein the method includes selecting a polymer foam nail guide having one or more slits wherein each slit is adapted for inserting a nail, inserting a nail into the slit, positioning the nail guide with the nail on the workpiece, setting the angle of the nail, seating the nail by driving it partly into the workpiece, and removing the nail guide from the workpiece.

In still another embodiment of the current invention a method is provided for guiding a nail wherein the method includes selecting a polymer foam nail guide having a slit adapted for inserting a nail and a straight line mark perpendicularly intersecting the slit, inserting a nail into the slit at the point where the mark intersects the slit, positioning the nail guide with the nail on a marked position of the workpiece, seating the nail by driving it partly into the workpiece, and removing the nail guide from the workpiece.

In another embodiment of the present invention a method is provided for guiding a nail wherein the method includes selecting a polymer foam nail guide having a slit adapted for inserting a nail wherein the slit extends from the edge of the foam body and having one or more adhesive layers applied to the surface of the foam body, inserting a nail into the slit, positioning the nail guide with the Bail on the workpiece, temporarily adhesively bonding the foam body to the tip of a finger or to the surface of the workpiece, seating the nail by driving it partly into the workpiece, and removing the nail guide from the workpiece.

In still another embodiment of the current invention, a method is provided for guiding a plurality of nails wherein the method includes selecting a polymer foam body having a plurality of slits wherein each slit is adapted for inserting a nail, inserting a nail into each slit, positioning the nail guide with the nails on the workpiece, seating the nails by driving them partly into the workpiece, and removing the nail guide from the workpiece.

DETAILED DESCRIPTION OF THE INVENTION

Figure 1:
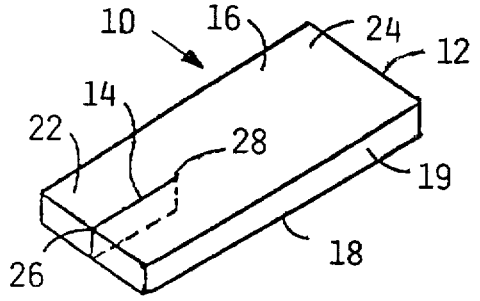
FIG. 1 is a schematic perspective view illustrating a nail guide of the present invention.

While describing the invention and its embodiments, certain terminology will be utilized for the sake of clarity. It is intended that such terminology include not only the recited embodiments but all equivalents which perform substantially the same function, in substantially the same manner to achieve substantially the same result.

A nail has three main parts: (1) a point, (2) a head and 3 a body or shank between the point and the head. While most nails have a smooth round shank some types of nails have a shank which is twisted, threaded or ringed. Also, some nail shank cross sections are triangular, square or rectangular. Nails having a roughened or resin coated shank are used to provide a tighter grip. Examples of nails which are suitable for use with nail guides of the present invention are: common nails, box nails, anchor nails, screw nails, easing nails, ringed shank nails, brads, tacks and upholstery nails. The invention is also suitable for guiding or holding staples.

The present invention utilizes polymer foam bodies. Polymer foams are also known as cellular plastics, expanded plastic and foamed plastic when the polymer comprises a plastic, such as, polyethylene. Polymer foams are commonly known as foam rubber or sponge when they are based on an elastomer polymer, such as, for example, natural rubber. Gas filled cells are dispersed throughout polymer foam to reduce the density of the polymer. These foams can have a closed cell configuration wherein each cell is enclosed by polymer, or have an open cell structure wherein individual cells are intercommunicating. A variety of gases are used in polymer foams, such as, for example, air, nitrogen, and carbon dioxide. Polymer foams find widespread use in many different applications.

The term polymer foam as defined herein includes two-phase gas-solid systems having a solid continuous phase comprising one or more plastic or elastomer polymers.

Polymer foams are generally characterized as either flexible or rigid. Polymer foams which are suitable for nail guides of the present invention are flexible, requiring sufficient flexibility to allow bending a 1 inch thick foam slab at room temperature around a cylindrical mandrel having a 1 inch diameter, without causing substantial cracking of the foam.

Polymer foams are produced in a wide range of densities. Polymer foams suitable for nail guides of the present invention have a density which ranges from about 0.7 pounds per cubic foot (pcf) to about 10 pcf. A preferred density range is from about 1.5 pcf to about 5 pcf.

Following are examples of plastic and elastomer polymers which are suitable for use in the nail guide polymer bodies of the present invention: ethylene-vinylacetate copolymer, natural rubber, polychloroprene, polyethylene, plyisoprene, polyolefin, polypropylene, polyurethane, polyvinyl acetate, polyvinyl chloride and styrene-butadiene copolymer.

An example of a preferred foam for use in the present invention is a closed cell flexible polyethylene foam having a density of 2 pcf. This type of foam is commercially available as MINICEL® type M200 from Voltek, Division of Sekisui America Corp., located in Lawrence, Mass.

One embodiment of the present invention is illustrated in FIG. 1, showing nail guide 10 having a flexible polymer foam body 12 and a slit 14. Foam body 12 has a first surface 18, a second 16 and a peripheral edge 19. Preferably, first surface 18 is a substantially flat surface. Second surface 16 is preferably substantially parallel to first surface 18. Slit 14 is positioned in a first end 22 of foam body 12 between a starting point 26 which is positioned at peripheral edge 19, and a terminal point 28. Second end 24 of foam body 12 opposes first end 22. Slit 14 is positioned substantially perpendicular to first surface 18. FIG. 1 illustrates a slit which is positioned approximately along the central longitudinal axis of foam body 12. However, the invention is equally operable when the slit is not positioned along the central longitudinal axis of the foam body.

The thickness of foam body 12 is measured as the thickness between first surface 18 and second surface 16. While the thickness of foam body 12 is not critical for the current invention, a preferred thickness range is from about ⅛ inch to about 1 inch and particularly from about ⅜ inch to about ⅝ inch. The length of slit 14, as measured between starting point 26 and terminal point 28, is not critical. A preferred range is from about ⅛ inch to about 1 inch, particularly from about ⅜ to about ¾ inch. Preferably, terminal point 28 is positioned at least about ⅛ inch from peripheral edge 19.

Figure 2:
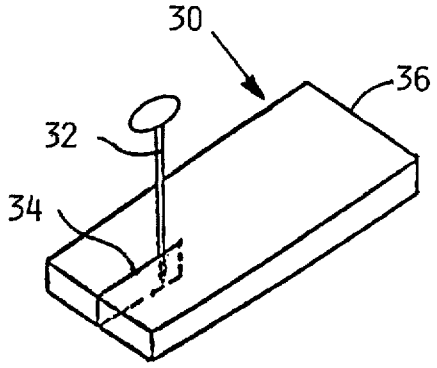
FIG. 2 is a schematic perspective view of an alternate nail guide of the present invention.

FIG. 2 shows nail guide 30. In this embodiment nail 32 is inserted at a predetermined position in slit 34 of foam body 36, which is similar to foam body 12 illustrated in FIG. 1. FIG. 2 illustrates a nail which is set in the slit approximately perpendicular to the first surface of the foam body. However the configuration of the slit, thickness of the foam body and the physical properties of the polymer foam allow the nail to be set at any desired angle with respect to the first surface of the foam body by setting the nail at an angle in the slit.

Figure 3:
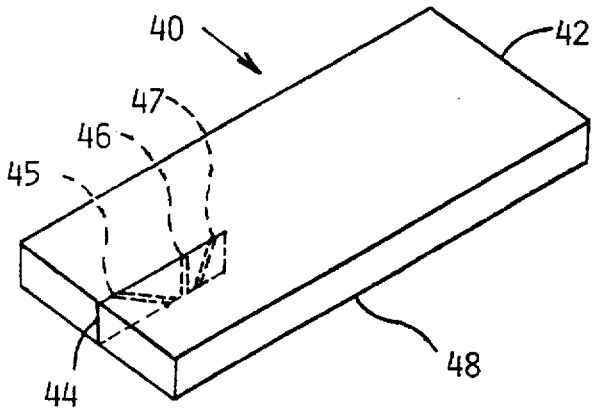
FIG. 3 is a schematic perspective view of an alternate nail guide of the present invention.

In order to more precisely guide a nail, one or more grooves may be provided at predetermined positions in one or both sides of the slit as shown in FIG. 3 depicting foam body 42 of nail guide 40 which includes slit 44. Foam body 42 is similar to foam body 12 (FIG. 1) except that one side of slit 44 is provided with grooves 45, 46 and 47 which are at predetermined angles with respect to the first surface 48. In the embodiment shown in FIG. 3, grooves 45, 46 and 47 are at 30, 90 and 60 degree angles respectively.

Figure 4:
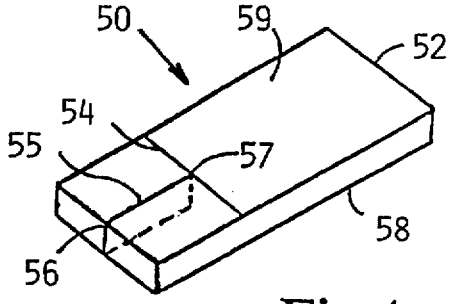
FIG. 4 is a schematic perspective view of an alternate nail guide of the present invention.

The embodiment shown in FIG. 4 illustrates a nail guide 50 having a foam body 52 similar to foam body 12 (FIG. 1), additionally including a straight line mark 54. Foam body 52 has a slit 55 which begins at the peripheral edge at a starting point 56 and ends at a terminal point 57. Mark 54 intersects slit 55 at an angle of about 90 degrees at the terminal point 57. Alternately, the straight line mark can be positioned such that it perpendicularly intersects the slit at a predetermined point.

Figure 5:
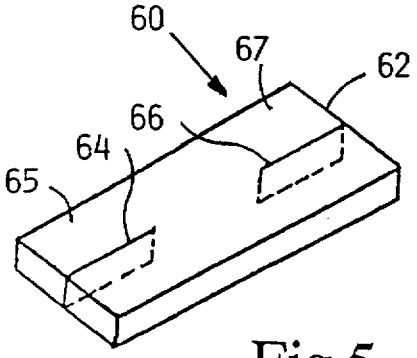
FIG. 5 is a schematic perspective view of an alternate nail guide of the present invention.

As shown in FIG. 5, a second slit can be provided in foam bodies similar to foam bodies 12, 36, 42 and 52. Foam body 62 of nail guide 60 has a first slit 64 in a first end 65 and a second slit 66 in a second end 67. Slits 64 and 66 are similar to slit 14 of nail guide 10.

Figure 6:
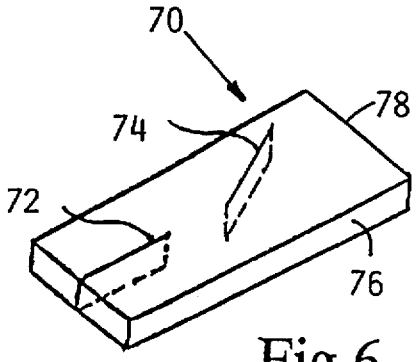
FIG. 6 is a schematic perspective view of an alternate nail guide of the present invention.

The second slit need not be positioned in a straight line with the first slit. Also the second slit need not start at the peripheral edge as illustrated in nail guide 70 (FIG. 6). First slit 72 is similar to slit 14 of nail guide 10 but second slit 74 is not connected to the peripheral edge 76 of foam body 78. Also slits 72 and 74 are not in a straight line relationship.

Embodiments of the present invention which are provided with one or more adhesive layers on the foam bodies provide additional benefits. Different types of adhesives can be used, but adhesives which are known as "pressure sensitive adhesives"0 (PSA) are preferred. PSA are adhesives which remain somewhat tacky and which provide a relatively low bond strength between the adhesive and smooth rigid substrates thus resulting in an adhesive which has an easily removable, temporary bond with such substrates. Pressure sensitive adhesives are well known in the art. Examples of PSA which are suitable for the present invention are described in U.S. Pat. No. 3,922,464 (Silver et al., 1975), herein incorporated by reference.

It is well known that an exposed PSA layer needs to be covered with a release sheet in order to prevent unwanted adhesion when the PSA layer makes unintentional contact with a substrate. Such release sheets are well known in the art. Suitable compounds for obtaining a non-adherent, release coating on sheet materials are described in U.S. Pat. No. 3,900,617 (Grenoble, 1975), herein incorporated by reference.

Figure 7:
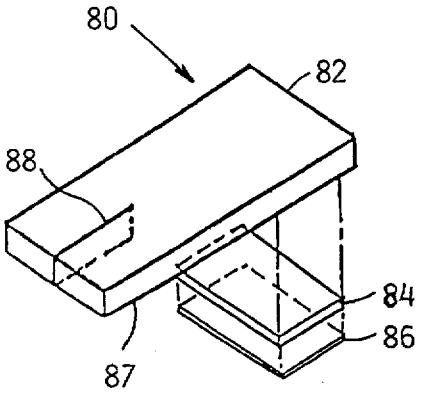
FIG. 7 is a schematic perspective view of an alternate nail guide of the present invention.

FIG. 7, showing nail guide 80, illustrates a foam body 82 which is provided with a PSA layer 84 having a predetermined layer thickness. Release sheet 86 covers the PSA. PSA layer 84 is applied to first surface 87 of foam body 82. Techniques for applying a PSA layer to a surface are well known to those skilled in the art. Examples of such techniques are described in the '464 patent. The position of adhesive layer 84 on first surface 87 is not critical. Preferably, the adhesive should not be positioned in close proximity to slit 88, i.e. not within approximately ¼ inch of this slit.

Nail guide 90 (FIG. 8) illustrates an alternate embodiment of a foam body additionally having PSA and a release sheet. PSA used in nail guide 90 comprise three layers: (1) a first PSA layer 93, (2) a carrier or backing 94, such as, paper or plastic and (3) a second PSA layer 95. Adhesive tapes which include PSA layers bonded to both sides of a carrier are well known to those skilled in the art, such tapes are commercially available and these are commonly referred to as double sided adhesive tapes. The exposed surface of PSA layer 95 is covered with release sheet 96.

Figure 9:
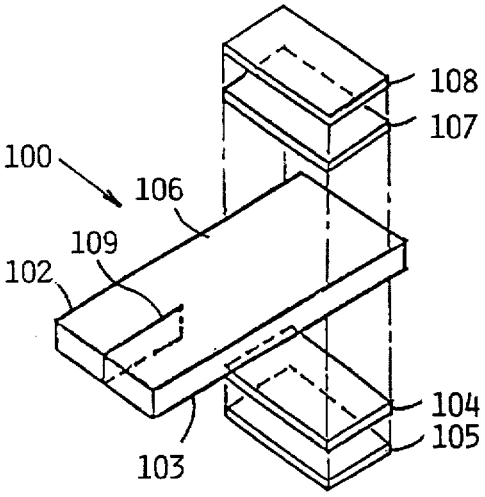
FIG. 9 is a schematic perspective view of an alternate nail guide of the present invention.
Figure 10:
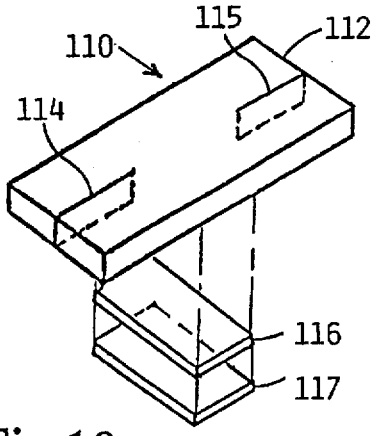
FIG. 10 is a schematic perspective view of an alternate nail guide of the present invention.

Nail guide 100 of FIG. 9 depicts a foam body 102 having PSA applied to both surfaces of the foam body. PSA layer 104 is applied to first surface 103 of foam body 102. The exposed surface of PSA layer 104 is covered with release sheet 105. PSA layer 107 is applied to second surface 106 of foam body 102. The exposed surface of PSA layer 107 is covered with release sheet 108 such that the release sheet is contiguous with the exposed surface of the PSA layer. Preferably, PSA layers 104 and 107 should not be positioned in close proximity to slit 109, i.e. not within approximately ¼ inch of this slit.

Where the foam body has two or more slits, the PSA is preferable applied in a position which is intermediate the slits, as illustrated in FIG. 10. Foam body 112 includes slits 114 and 115. PSA layer 116 is applied intermediate slits 114 and 115. Release sheet 117 covers the exposed surface of PSA layer 116.

The embodiments of the present invention wherein one or more adhesive layers are employed are illustrated herein with adhesive layers which cover the entire width of the foam bodies. However, the invention is equally operable when the adhesive layer does not cover the entire width of the foam bodies.

While the invention has been illustrated with foam bodies having one or two slits, the invention is equally operable with foam bodies having multiple slits. The above embodiments of the present invention are illustrated using flexible polymer foam bodies having an approximately rectangular shape. The invention is equally operable when the foam body has a non-rectangular shape, such as, for example an oval or circular shape. The length and width of the foam bodies is not critical. A preferred length range is from about 1 ¼ inch to about 3 ½ inch. A preferred width range is from about ¾ inch to about 1 ¾ inch.

Figure 11:
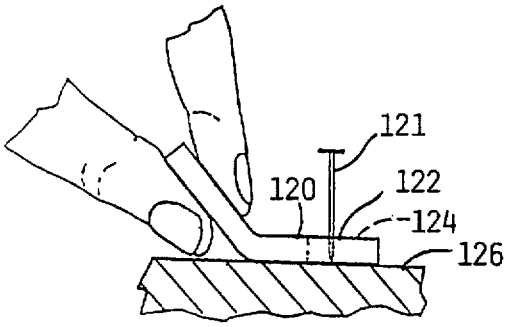
FIG. 11 is a side elevation view of the nail guide illustrated in FIG. 2, being positioned on a workpiece.

Nails are held and guided with the nail guides of the present invention using the following methods. For example, FIG. 11 shows the shaft of nail 121 inserted in slit 124 of nail guide 120 which is similar to nail guide 30 (FIG. 2). Nail guide 120 can be held with the fingers while the nail containing portion of foam body 122 is placed in contact with workpiece 126. A hammer or other impact tool is used to strike the head of the nail until the nail is seated in the workpiece such that the nail no longer needs to be held or guided. The nail guide is then removed before fully driving the nail into the workpiece.

Similarly, a nail guide with a nail inserted, such as nail guide 30 (FIG. 2), can be placed on a workpiece. The nail guide can be held in place by pressing the foam body against the workpiece by means of a finger. The nail is then seated and driven into the workpiece as described in connection with nail guide 120.

Figure 12:
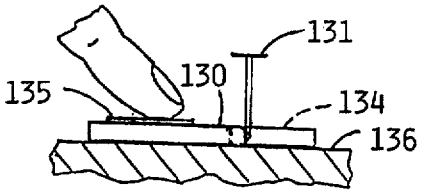
FIG. 12 is a side elevation view of the nail guide illustrated in FIG. 7, being positioned on a workpiece while being temporarily bonded to a finger tip.

In another embodiment of the current invention, a nail guide 130 similar to nail guides 80 (FIG. 7) or 90 (FIG. 8) is utilizing as follows. A nail 131 is inserted in slit 134 of nail guide 130 (FIG. 12). The release sheet is removed from nail guide 130, exposing PSA layer 135. A finger tip is pressed against the PSA, enabling the user to manipulate and hold nail guide 130 with just one finger. The nail guide is then positioned and used on workpiece 136 in the manner described in connection with nail guide 120. The release sheet can be replaced on PSA layer 135 after removal of the nail guide from the workpiece.

FIGS. 11 and 12 illustrate the insertion of the nail at a point intermediate the starting point and the terminal point. Other positions can also be chosen for insertion of the nail into the slit, such as, at the slit's terminal point. Employing a nail guide, such as nail guide 40, (FIG. 3), the user is able to seat and drive the nail at a predetermined angle into the workpiece.

In an additional method, the nail is held on the desired position of the workpiece by placing the point of the nail on the workpiece and holding the nail in position through finger pressure on the head of the nail. A nail guide, such as nail guide 10 (FIG. 1), is then utilized as follows. The nail is inserted into the nail guide by moving the nail guide on the workpiece such that the slit's starting point is pushed against the nail. The nail guide can then be pushed against the nail until the shank of the nail enters the slit. Once the nail is properly seated in the slit, the finger is removed from the head of the nail and the nail is seated and driven into the workpiece as described in connection with nail guide 120 (FIG. 11). This particular use of the current nail guides assists the user in the precise placement of a nail on a workpiece.

Nail guide 50 (FIG. 4) can be employed in another technique for the accurate positioning of a nail on a workpiece. Nail guide 50 includes a straight line mark 54 on the second surface 59 of the foam body. This method is as follows. Two right angled lines are drawn on the surface of the workpiece, wherein the right angled lines intersect at the precise position for the nail. Alternately, these right angled lines may be drawn on masking tape covering the surface of the workpiece. A nail is then inserted in slit 55 at terminal point 57 of nail guide 50, i.e. where the line mark intersect the slit. The first surface 58 of the nail guide is then placed on the workpiece and positioned such that one of the right angled lines coincides with slit 55 and such that the other right angled line coincides with line mark 54. The nail is subsequently seated and driven into the workpiece as described in connection with nail guide 120 (FIG. 11).

Nail guides of the present invention having two or more slits provide additional slits which can be used after the first slit has been damaged due to repeated use. Also, the present nail guides having multiple slits can be used to insert a nail in each of the multiple slits for the proper positioning of a plurality of nails on a workpiece by having the proper positions marked on the nail guide.

Figure 8:
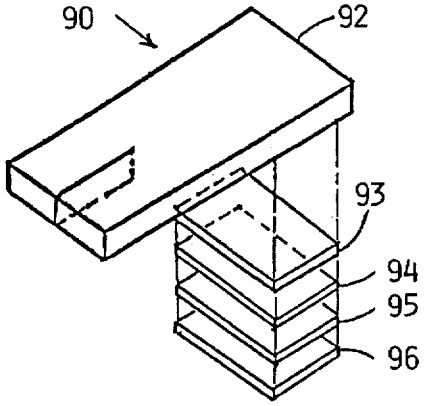
FIG. 8 is a schematic perspective view of an alternate nail guide of the present invention.
Figure 13:
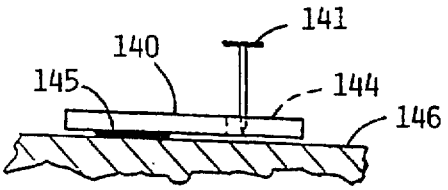
FIG. 13 is a side elevation view of the nail guide illustrated in FIG. 7, temporarily bonded to a workpiece.

Nail guides of the present invention are especially useful for driving nails into a workpiece which needs to be held in position while the nail is driven into the workpiece, as is shown in FIG. 13 using nail guides similar to nail guides 80, 90 and 110 (FIGS. 7, 8 and 10 respectively). A nail 141 is inserted into slit 144 and the release sheet is removed. Nail guide 140 is placed in the proper position on the workpiece, with the exposed PSA layer 145 contacting the surface of workpiece 146. The nail guide is temporarily bonded to the workpiece by pressing the nail guide onto the workpiece at the position of PSA layer 145. This enables the user to hold the workpiece with one hand while driving the nail into the workpiece with the other hand. Once the nail is properly seated in the workpiece, the nail guide is removed by pulling it from the surface of the workpiece at the position of the adhesive layer and the release sheet can then be replaced on PSA layer 145. The nail is subsequently driven into the workpiece.

The procedures depicted in FIGS. 12 and 13 can be combined by utilizing a nail guide of the present invention having PSA layers on both surfaces of the foam body such as nail guide 100 (FIG. 9). After insertion of a nail in slit 109, release sheet 108 is removed and a finger tip is temporarily bonded to PSA layer 107. Next, release sheet 105 is removed and the nail guide is positioned on the workpiece by manipulating it with the finger. The nail guide is then temporarily bonded to the surface of the workpiece through PSA layer 104 and the finger is removed from the nail guide. The nail is seated and driven into the workpiece as described in connection with nail guide 140 above. This procedure is particularly useful if the nail needs to be driven in a position which is difficult to reach.

Figure 14:
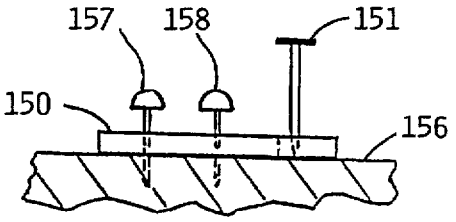
FIG. 14 is a side elevation view of the nail guide illustrated in FIG. 2, temporarily attached to a workpiece.

Alternately, the nail guide 150 (similar to nail guides 10, 30, 40, 50, 60 and 70) including a nail 151 can be temporarily attached to a workpiece 156 by pressing one or more thumb tacks, such as thumb tacks 157 and 158, through the foam body into the workpiece (see FIG. 14). The low density of the foam material makes it suitable for the use of thumb tacks thus resulting in relatively minor damage to the surface of the workpiece and providing a nail guide attachment technique which requires minimal skill and minimal muscle strength. This technique enables the user to hold the workpiece with one hand while driving the nail into the workpiece with the other hand.

FIGS. 13 and 14 illustrate techniques for temporarily attaching nail guides of the present invention to a workpiece. Handicapped persons who are limited to the use of only one hand can use these techniques to guide and drive a nail into a workpiece.

Nail guides of the present invention are particularly useful when the surface of the workpiece is uneven or non-flat because the foam bodies are easily deformed due to the flexibility and low density of the foam bodies. The flexibility and low density also enable persons with impaired finger use to hold the nail guide and effectively guide and drive a nail into a workpiece. Similarly, these devices are useful for teaching children how to use a hammer and nails since the nail guides of the current invention greatly reduce the risk of hitting one's fingers or thumb with the hammer.

The present nail guides which include one or more PSA layers enable the user to more easily manipulate the nail guide by temporarily bonding it to the user's finger. The PSA layer also permits the temporary bonding of the nail guide to the workpiece which is particularly useful if the workpiece needs to be held in place or if the user is handicapped and can only use one hand. The PSA layer also facilitates storage of these devices since the devices can be temporarily bonded to the sides of a tool box or storage cabinet.

It is believed that the unexpected benefits which are derived from the current invention are due to a combination of inventive features. These features include: (1) the selection of the material for the body of the nail guide, i.e. flexible polymer foam, particularly such foams having a density ranging from about 0.7 pcf to about 10 pcf, (2) the selected thickness range of the foam bodies, (3) the dimensions and positioning of one of more slits in the foam body and (4) optional features such as: (i) one or more grooves along at least one side of the slit, (ii) one or more straight line marks intersecting one or more slits, (iii) one or more adhesive layers applied to one or both sides of the flexible foam body and (iv) combinations of several or all of the above features. These features cause a nail to be firmly seated in the nail guide and enable unskilled and even handicapped persons to use the nail guides of the present invention on a variety of workpieces under a variety of circumstances, thereby substantially overcoming the shortcomings of prior art nail guides.

The invention has been described in terms of the preferred embodiments. One skilled in the art will recognize that it would be possible to construct the elements of the present invention from a variety of means and to modify the placement of components in a variety of ways. While the preferred embodiments have been described in detail and shown in the accompanying drawings, it will be evident that various further modifications are possible without departing from the scope of the invention as set forth in the following claims.

I claim:

1. A nail guide comprising a flexible polymer foam body, wherein the foam body comprises:

a) a first end;

b) a second end opposing the first end;

c) a first surface;

d) a second surface opposing the first surface;

e) a peripheral edge between the first surface and the second surface;

f) a predetermined thickness between the first surface and the second surface, wherein the predetermined thickness ranges from about ⅛ inch to about 1 inch; and g) an area defining a slit adapted for receiving a nail, wherein the slit: (1) is positioned in the foam body first end, (2) extends through the foam body from the first surface to the second surface, (3) is provided along a plane which is substantially perpendicular to the first surface, (4) has a first side and a second side, (5) begins at a starting point which is positioned at the peripheral edge, (6) ends at a terminal point, (7) has a predetermined distance between the starting point and the terminal point which ranges from about ⅛ inch to about 1 inch, (8) has a first region along the first side defining a first groove such that the first groove extends from the first surface to the second surface, in which the first groove is positioned at an angle of about 90 degrees with respect to the first surface, wherein the first groove is adapted for receiving a nail and (9) has a second region along the first side defining a second groove such that the second groove extends from the first surface to the second surface, in which the second groove is positioned at an angle of about 30 degrees with respect to the first surface, wherein the second groove is adapted for receiving a nail.

2. The nail guide according to claim 1 additionally comprising a third region defining a third groove along the first side such that the third groove extends from the first surface to the second surface in which the third groove is positioned at an angle of about 60 degrees to the first surface, wherein the third groove is adapted for receiving a nail.

3. The nail guide according to claim 2 comprising a first straight line mark on the second surface in which the first mark intersects the first slit at a predetermined position such that the first mark is substantially perpendicular to the first slit, wherein the first mark extends across the second surface to the peripheral edge.

4. A nail guide comprising a flexible polymer foam body, wherein the foam body comprises:

a) a first end;

b) a second end opposing the first end;

c) a first surface;

d) a second surface opposing the first surface;

e) a peripheral edge between the first surface and the second surface;

f) a predetermined thickness between the first surface and the second surface, wherein the predetermined thickness ranges from about ⅜ inch to about ⅝ inch;

g) a first area defining a first slit adapted for receiving a nail, wherein the first slit: (1) is positioned in the foam body first end, (2) extends through the foam body from the first surface to the second surface, (3) is provided along a plane which is substantially perpendicular to the first surface, (4) has a first side and a second side, (5) begins at a first starting point which is positioned at the peripheral edge, (6) ends at a first terminal point, (7) has a predetermined distance between the first starting point and the first terminal point which ranges from about ⅜ inch to about ¾ inch, (8) has a first region along the first side defining a first groove such that the first groove extends from the first surface to the second surface, in which the first groove is positioned at an angle of about 90 degrees with respect to the first surface, wherein the first groove is adapted for receiving a nail, (9) has a second region along the first side defining a second groove such that the second groove extends from the first surface to the second surface, in which the second groove is positioned at an angle of about 60 degrees with respect to the first surface, wherein the second groove is adapted for receiving a nail and (10) has a third region along the first side defining a third groove such that the third groove extends from the first surface to the second surface, in which the third groove is positioned at an angle of about 30 degrees with respect to the first surface, wherein the third groove is adapted for receiving a nail; and h) a second area defining a second slit adapted for receiving a nail, wherein the second slit: (1) is positioned in the foam body second end, (2) extends through the foam body from the first surface to the second surface, (3) is provided along a plane which is substantially perpendicular to the first surface, (4) has a third side and a fourth side, (5) begins at a second starting point which is positioned at the peripheral edge, (6) ends at a second terminal point, (7) has a predetermined distance between the second starting point and the second terminal point which ranges from about ⅜ inch to about ¾ inch, (8) has a fourth region along the third side defining a fourth groove such that the fourth groove extends from the first surface to the second surface, in which the fourth groove is positioned at an angle of about 90 degrees with respect to the first surface, wherein the fourth groove is adapted for receiving a nail, (9) has a fifth region along the third side defining a fifth groove such that the fifth groove extends from the first surface to the second surface, in which the fifth groove is positioned at an angle of about 60 degrees with respect to the first surface, wherein the fifth groove is adapted for receiving a nail and (10) has a sixth region along the third side defining a sixth groove such that the sixth groove extends from the first surface to the second surface, in which the sixth groove is positioned at an angle of about 30 degrees with respect to the first surface, wherein the sixth groove is adapted for receiving a nail.

5. The nail guide according to claim 4 wherein the polymer comprises polyethylene.

6. The nail guide according to claim 4 additionally comprising:

a) a first straight line mark on the second surface in which the first mark intersects the first slit at a predetermined position such that the first mark is substantially perpendicular to the first slit; and b) a second straight line mark on the second surface in which the second mark intersects the second slit at a predetermined position such that the second mark is substantially perpendicular to the second slit.

7. The nail guide according to claim 4 additionally comprising:

a) a first pressure sensitive adhesive layer contacting the first surface intermediate the first slit and the second slit; and b) a first release sheet contacting the first adhesive layer such that the first adhesive layer is interposed between the first surface and the first release sheet.

8. The nail guide according to claim 7 additionally comprising:

a) a second pressure sensitive adhesive layer contacting the second surface intermediate the first slit and the second slit; and b) a second release sheet contacting the second adhesive layer such that the second adhesive layer is interposed between the second surface and the second release sheet.

9. The nail guide according to claim 7 wherein the first pressure sensitive adhesive layer comprises:

a) a third pressure sensitive adhesive layer which contacts the first surface;

b) a carrier which contacts the third adhesive layer such that the third adhesive layer is interposed between the first surface and the carrier; and c) a fourth pressure sensitive adhesive layer which contacts the carrier such that the fourth adhesive layer is interposed between the carrier and the first release sheet.

10. A nail guide comprising a flexible polymer foam body, wherein the foam body comprises:

a) a first end;

b) a second end opposing the first end;

c) a first surface;

d) a second surface opposing the first surface;

e) a peripheral edge between the first surface and the second surface;

f) a predetermined thickness between the first surface and the second surface, wherein the predetermined thickness ranges from about ⅛ inch to about 1 inch; and g) a first area defining a first slit adapted for receiving a nail, wherein the first slit: (1) is positioned in the foam body first end, (2) extends through the foam body from the first surface to the second surface, (3) is provided along a plane which is substantially perpendicular to the first surface, (4) has a first side and a second side, (5) begins at a starting point which is positioned at the peripheral edge, (6) ends at a terminal point, (7) has a predetermined distance between the starting point and the terminal point which ranges from about ⅛ inch to about 1 inch, (8) has a first region along the first side defining a first groove such that the first groove extends from the first surface to the second surface, in which the first groove is positioned at a first predetermined angle with respect to the first surface, wherein the first groove is adapted for receiving a nail and (9) has a second region along the first side defining a second groove such that the second groove extends from the first surface to the second surface, in which the second groove is positioned at a second predetermined angle with respect to the first surface and in which the second angle is smaller than the first angle, wherein the second groove is adapted for receiving a nail.

11. The nail guide according to claim 10 additionally comprising a third region along the first side defining a third groove such that the third groove extends from the first surface to the second surface, in which the third groove is positioned at a third predetermined angle with respect to the first surface and in which the third angle is smaller than the second angle, wherein the third groove is adapted for receiving a nail.

12. The nail guide according to claim 10 wherein the polymer foam body has a foam density which ranges from about 0.7 pcf to about 10 pcf.

13. The nail guide according to claim 10 additionally comprising an adhesive layer contacting the first surface.

14. The nail guide according to claim 10 wherein the foam comprises a plastic polymer.

15. A combination of a nail guide and a nail comprising:

a) the nail guide comprising a flexible polymer foam body wherein the foam body comprises: (1) a first end, (2) a second end opposing the first end, (3) a first surface, (4) a second surface opposing the first surface, (5) a peripheral edge between the first surface and the second surface, (6) a predetermined thickness between the first surface and the second surface, wherein the predetermined thickness ranges from about ⅛ inch to about 1 inch; and (7) an area defining a slit adapted for receiving a nail, wherein the slit: (i) is positioned in the foam body first end, (ii) extends through the foam body from the first surface to the second surface, (iii) is provided along a plane which is substantially perpendicular to the first surface, (iv) has a first side and a second side, (v) begins at a starting point which is positioned at the peripheral edge, (vi) ends at a terminal point and (vii) has a predetermined distance between the starting point and the terminal point which ranges from about ⅛ inch to about 1 inch, (viii) has a region along the first side defining a first groove such that the first groove extends from the first surface to the second surface, in which the first groove is positioned at a first angle with respect to the first surface, wherein the first groove is adapted for receiving a nail and (ix) has a second region along the first side defining a second groove such that the second groove extends from the first surface to the second surface, in which the second groove is positioned at a second predetermined angle with respect to the first surface and in which the second angle is smaller than the first angle, wherein the second groove is adapted for receiving a nail; and b) the nail inserted in a predetermined groove which is selected from the group of grooves consisting of the first groove and the second groove, such that the nail is inserted into the predetermined groove through the second surface.

16. A method of guiding a nail comprising the steps of:

a) selecting a nail guard comprising a flexible polymer foam body wherein the foam body comprises: (1) a first surface, (2) a second surface opposing the first surface, (3) a peripheral edge between the first surface and the second surface, (4) an area defining a slit extending through the foam body such that the slit starts at the peripheral edge and is substantially perpendicular to the first surface wherein the slit has a first side and a second side, (5) a first region along the first side defining a first groove such that the first groove extends from the first surface to the second surface, in which the first groove is positioned at a first predetermined angle with respect to the first surface, wherein the first groove is adapted for receiving a nail and (6) a second region along the first side defining a second groove such that the second groove extends from the first surface to the second surface, in which the second groove is positioned at a second predetermined angle with respect to the first surface and in which the second angle is smaller than the first angle, wherein the second groove is adapted for receiving a nail;

b) inserting the nail into a predetermined groove which is selected of the group of grooves consisting of the first groove and the second groove, such that the nail is inserted into the predetermined groove through the second surface;

c) selecting a workpiece;

d) selecting a position on the workpiece for driving the nail, e) placing the nail guide on the workpiece such that the nail is positioned on the selected position;

f) striking the nail with an impact tool until the nail is seated in the workpiece; and g) removing the nail guide from the workpiece.

* * * * *